US008833524B2

(12) United States Patent
De Coi et al.

(10) Patent No.: US 8,833,524 B2
(45) Date of Patent: Sep. 16, 2014

(54) MONITORING DEVICE FOR SAFEGUARDING A DRIVEN ELEMENT

(75) Inventors: Beat De Coi, Sargans (CH); Tobias Leutenegger, Chur (CH)

(73) Assignee: Cedes AG, Landquart (CH)

( * ) Notice: Subject to any disclaimer, the term of this patent is extended or adjusted under 35 U.S.C. 154(b) by 604 days.

(21) Appl. No.: 13/173,594

(22) Filed: Jun. 30, 2011

(65) Prior Publication Data

US 2012/0000728 A1 Jan. 5, 2012

(30) Foreign Application Priority Data

Jul. 5, 2010 (DE) ..... 10 2010 026 140

(51) Int. Cl.
*B66B 13/14* (2006.01)
*B66B 13/26* (2006.01)

(52) U.S. Cl.
CPC ..... *B66B 13/26* (2013.01)
USPC ..... 187/316; 187/391

(58) Field of Classification Search
USPC ..... 187/247, 313, 316, 317, 391–394; 318/466–470; 49/26, 28
See application file for complete search history.

(56) References Cited

U.S. PATENT DOCUMENTS

| | | | | |
|---|---|---|---|---|
| 3,903,996 | A | 9/1975 | Berkovitz et al. | |
| 4,029,176 | A * | 6/1977 | Mills | 187/317 |
| 4,452,009 | A | 6/1984 | Baumeler et al. | |
| 4,621,452 | A * | 11/1986 | Deeg | 49/28 |
| 4,866,881 | A * | 9/1989 | Morrow et al. | 49/25 |
| 4,914,859 | A * | 4/1990 | Gionet et al. | 49/25 |
| 5,149,921 | A | 9/1992 | Picado | |
| 5,569,888 | A * | 10/1996 | Kamani et al. | 187/317 |
| 6,169,379 | B1 * | 1/2001 | Zhang et al. | 318/280 |
| 6,247,558 | B1 * | 6/2001 | Bailey et al. | 187/317 |
| 6,435,315 | B1 * | 8/2002 | Zaharia | 187/394 |
| 6,612,403 | B2 * | 9/2003 | Silberhorn et al. | 187/394 |
| 6,651,781 | B2 * | 11/2003 | Lindegger et al. | 187/394 |
| 6,877,587 | B2 * | 4/2005 | Kunz et al. | 187/394 |
| 6,886,667 | B2 * | 5/2005 | Kunz et al. | 187/394 |
| 7,032,348 | B1 * | 4/2006 | Epps et al. | 49/25 |
| 7,093,692 | B2 * | 8/2006 | Koura | 187/316 |
| 7,755,024 | B2 | 7/2010 | Platt et al. | |
| 7,771,080 | B2 * | 8/2010 | Platt | 362/231 |
| 8,115,162 | B2 * | 2/2012 | Shikai et al. | 250/221 |
| 8,584,809 | B2 * | 11/2013 | Sun et al. | 187/316 |

FOREIGN PATENT DOCUMENTS

| | | |
|---|---|---|
| CN | 101 811 638 A | 8/2010 |
| DE | 1 007 036 B | 4/1957 |
| DE | 43 34 785 A1 | 5/1994 |
| DE | 43 12 947 C1 | 6/1994 |

(Continued)

OTHER PUBLICATIONS

European Examination Report dated Mar. 19, 2012.

*Primary Examiner* — Anthony Salata
(74) *Attorney, Agent, or Firm* — Burr & Brown, PLLC

(57) ABSTRACT

A monitoring device for safeguarding a driven element against undesired collisions with an object lying on the movement path of the driven element including at least one transmitting element and a multiplicity of receiving elements, wherein the at least one transmitting element is arranged in a horizontal boundary region of an opening to be monitored, where the opening can be at least partially closed by the driven element, and the multiplicity of receiving elements are arranged in a horizontal, opposite boundary region in a distributed fashion along the opening to be monitored, wherein the at least one transmitting element, together with each of the multiplicity of receiving elements forms a light barrier arrangement, which can be evaluated individually.

20 Claims, 4 Drawing Sheets

(56) References Cited

FOREIGN PATENT DOCUMENTS

| | | | |
|---|---|---|---|
| DE | 198 05 980 | C1 | 7/1999 |
| EP | 0 081 110 | A1 | 6/1983 |
| EP | 0 661 228 | A2 | 7/1995 |
| EP | 2 165 961 | A1 | 3/2010 |
| FR | 2 685 496 | A1 | 6/1993 |
| WO | 2009/040911 | A1 | 4/2009 |

* cited by examiner

MONITORING DEVICE FOR SAFEGUARDING A DRIVEN ELEMENT

This application claims the benefit under 35 USC §119(a)-(d) of German Application No. 10 2010 026 140.8-22 having a filing date of Jul. 5, 2010, the entirety of which is incorporated herein by reference.

BACKGROUND OF THE INVENTION

1. Field of the Invention

The invention relates to a monitoring device for safeguarding a driven element, and an elevator comprising such a monitoring device.

2. Description of Related Art

Elevator doors can become dangerous for a passenger if they are not monitored and there is the risk of the passenger being trapped. This risk is nowadays reduced or even wholly eliminated by means of light barriers, light gratings, active and passive infrared sensors, ultrasonic sensors or else by means of mechanical pressure switches. In many cases, light gratings are used which form a horizontal grating of light barriers. These light gratings consist of a respective transmitting and receiving strip. Both strips are approximately two meter longitudinal slender profiles containing many transmitting and receiving elements generally incorporated in a manner distributed uniformly over the length. What is common to all of the sensor principles, however, is that they are comparatively expensive.

SUMMARY OF THE INVENTION

The invention is based on the object of realizing comparatively cost-effective safeguarding of, in particular, elevator doors.

The invention proceeds from a monitoring device for safeguarding a driven element against undesired collisions with an object situated on the movement path of the driven element. The monitoring device comprises at least one transmitting element and a receiving element. The heart of the invention then resides in the fact that the device is designed such that the at least one transmitting element, in an incorporated state, is arranged in a horizontal, in particular upper, boundary region of an opening to be monitored, which opening can be at least partially closed by the driven element, and in that a multiplicity of receiving elements are arranged in an opposite, horizontal, in particular lower, boundary region in distributed fashion along the opening to be monitored, wherein the at least one transmitting element, together with each of the multiplicity of receiving elements forms a light barrier arrangement, which can be evaluated in each case by evaluation means, in particular electronic means. The at least one transmitting element therefore serves a multiplicity of receiving elements by virtue of the at least one transmitting element "looking" toward a multiplicity of receiving elements. With this approach, involving the fact that the transmitting and receiving elements are not attached in the lateral boundary region of an e.g. door opening, but rather for example one above another on a door lintel or on a door threshold and, therefore, instead of conventionally horizontally operated light barriers, vertically or substantially vertically operated light barriers now arise, it is possible, firstly, e.g. to shorten the length of receiver strips to the door width. A door opening is generally narrow and high. Secondly, in the lintel region of the door, it is possible to dispense with monitoring the complete door width, with the result that the number of transmitting elements at the top, for example, can be kept small. The invention can be implemented even with a single transmitting element. However, two or three transmitting elements are preferably used.

Advantageously, the device is configured such that, in the horizontal, in particular upper, boundary region of an opening, a transmitting element is arranged in each case in a region of a left and right boundary of the opening, that is to say preferably comprises two transmitting elements in total. In the case of three transmitting elements, a transmitting element is additionally positioned centrally in a horizontally extending boundary region of the opening.

In order to achieve substantially whole-area monitoring of an opening region which can be swept over by a driven element, it is furthermore proposed that the device is designed in such a way that a multiplicity of receiving elements, along the opening to be monitored, are distributed over an at least approximately complete horizontally extending, in particular lower, opening region. By way of example, the receiving elements are distributed uniformly. In the opposite horizontal, in particular upper, region, in the case of this configuration, an area coverage is completed if two or three transmitting elements are used instead of one transmitting element.

Advantageously, electronic means are embodied which control transmitting elements such that the latter sequentially serve the receiving elements arranged in a distributed manner.

The receiving elements are preferably read in parallel by the electronic means. In this way, a multiplicity of monitoring beams formed between the at least one transmitting element and the individual receiving elements can be supervised simultaneously, as it were in one "shot".

In conventional light gratings, the individual transmitters and receivers have to be successively activated and read. This is necessary since otherwise simultaneously activated transmitters emit at a plurality of opposite receivers, as a result of which, upon interruption of an individual light path, a receiver can still receive light from another transmitter, and in this way the transmitters as it were radiate around an object to be detected.

If a plurality of transmitting elements are used in the present invention, they are preferably processed temporally sequentially, in which case the signal of an individual transmitting element can be evaluated simultaneously by all the receiving elements. Thus, monitoring of an opening region by means of a monitoring device according to the invention can be effected more rapidly by a multiple. If it is assumed, for example, that in the case of conventional door monitoring with a monitoring height of 1.80 m, objects of >50 mm are intended to be detected, 36 horizontal light barrier arrangements composed of transmitter and receiver that lie one above another are required. If they are read sequentially, the cycle time amounts to 36 triggering units. In the case of a monitoring device according to the invention comprising two transmitting elements that serve a multiplicity of receiving elements, the evaluation time in the case of parallel evaluation amounts to only two evaluation units, that is to say only one eighth of the time. This also does not take account of the fact that by means of a cross-beam evaluation in the case of a monitoring device according to the invention, the monitoring network is distinctly <50 mm. If there is a desire to achieve such precision in the case of a conventional light barrier arrangement, a cross-beam evaluation of three or e.g. five beams per element is additionally required, as a result of which the ratio of the read-out times deteriorates further by the factor three or five, respectively.

In order to obtain a greater monitoring density with which even extremely small objects can be detected in the monitoring region, it is furthermore proposed that the device is designed for arrangement of more than three transmitting elements in a horizontal, in particular upper, boundary region of an opening.

In a furthermore preferred configuration of the invention, the monitoring device is designed for mounting the receiving elements on an apron of a car of an elevator. The fitting of the receiving elements, e.g. in the form of a receiving strip, is conceivable in various ways, preferably by means of clips and/or screws.

Fitting the receiving elements in a door threshold of a car of an elevator, in particular in strip form, is also conceivable.

Standards prescribe that doors be monitored from 20 mm over the threshold to a height of 1.80 m. With conventional light gratings this requires sensor strips that are longer than 1.80 m, typically 2 m. In the case of the solution according to the invention, safeguarding door widths of between 800 mm and 1200 mm requires a receiving strip having receiving elements which has a length of 1200 mm. Thus, a packaging length can be almost halved, as a result of which the transport costs decrease. Moreover, the absolute number of required transmitters and receivers for achieving a comparable resolution capability of a monitoring device can be reduced. It is possible to employ two transmitting elements. Furthermore, by virtue of the shortening of the monitoring length in the case of monitoring with regard to the door width instead of the door height and the same receiving element density along a monitoring line in frequent cases it is possible to halve the number of receiving elements.

A receiving element strip is preferably mounted on an apron of a car of an elevator. In this case, it should be taken into account that a comparatively small gap of typically only 25 mm can be utilized between a shaft door threshold and a car door threshold. This gap is necessary in order that all positional and/or dimensional changes in the car, e.g. as a result of deflections during travel, cause no collision with a shaft door or shaft door rollers. Furthermore, it should be taken into account that the actual gap width is further reduced by virtue of the fact that, in general, shaft door rollers are fitted which project into the gap beyond a shaft threshold in order also to be able to open shaft doors by means of driven doors on the car.

Against this background, it is preferred if the thickness of a strip having the receiving elements and thus the construction space thereof into such a gap is limited to a maximum of 5 mm; preferably, 4 mm, even better 2 mm, should not be exceeded. The transmitter, too, should be embodied such that it is comparatively thin.

Such a small thickness of the sensor element strip can be utilized in order to configure the sensor element strip in flexible fashion. The height of such a strip, e.g. given a maximum thickness of 5 mm, can be 20-40 mm, in particular 30 mm. It is thus possible to achieve a dimensioning which, in a state mounted on a door lintel or a door threshold, is flexible about a vertical axis and in order that e.g. round aprons of correspondingly round elevator doors can be equipped by a receiving strip being adapted to the corresponding rounding of the apron by means of flexible bending.

Furthermore, it is advantageous that an upper side of the receiving elements, e.g. of a receiving strip, is oblique or rounded. In this way, any dirt which can inevitably arise through a gap between a car door threshold and shaft door threshold does not or substantially does not remain on an optically sensitive side. The receiving elements can be designed as a two-wire receiving chip, such that a multiplicity of receiving elements can be accommodated in a receiving strip in a simple manner.

On account of a predominantly uniform door width in the case of elevators, the door width can be covered with a single length for a receiving strip. It is thus possible to limit the necessary number of variants for receiving strips.

As a result of the accommodation of additional sensors in a receiving strip, which, by way of example, is to be positioned in the apron of a car of an elevator, it is additionally possible to realize car positioning with the receiving strip. This is preferably done in interaction with a coded shaft door apron. Absolute position information for the car can also be achieved by scanning of a coded tape embodied in the shaft along the traveling path of the car.

A better resolution capability of the monitoring device can be realized particularly for an increasingly closing door by virtue of the fact that the at least one transmitting element is mounted in a manner concomitant with moving on the driven element. As the driven element closes, the beam density and, consequently, the resolution capability become higher and higher. Thus, an increasing risk of trapping as the door closes can be counteracted by an increased detection resolution.

In a further particularly preferred configuration of the invention, transmitting and/or receiving elements are designed in such a way that, in an incorporated state, they have a significantly larger optical aperture angle along a horizontal opening width of an opening to be monitored than in a direction transversely with respect thereto. It is thus possible to restrict a signal intensity to a fan-shaped region in which signal detection and evaluation actually take place.

In an additionally preferred configuration of the invention, the at least one transmitting element is arranged in a horizontal, lower boundary region, whereas the receiving elements are provided in a horizontal upper boundary region of the opening to be monitored. Depending on the monitoring requirement, it is possible for the at least one transmitting element and the receiving elements to be fitted in the lower and upper horizontal boundary region, respectively, of an opening to be monitored, or exactly vice versa.

In a further preferred configuration of the invention, the evaluation means are designed in such a way that only those receiving elements which are situated in the opened region of an opening to be monitored are active. This measure makes it possible to further reduce the evaluation time through omission of receiving elements which are not active.

It is additionally preferred if the receiving elements and/or the at least one transmitting element are designed with optical waveguide means.

In this way, it is possible to shift light emitting members of the transmitting elements, e.g. LEDs, and/or receiving sensors of the receiving elements to locations which do not correspond to the locations at which, at an intervening optical waveguide, emergence of light takes place or a light beam is coupled into the optical waveguide for the purpose of evaluation. It is thereby conceivable to fit sensor elements of the receiving elements which are arranged completely differently than optical elements of the optical waveguide means that are positioned in a manner distributed in the e.g. lower horizontal region, the position of which determined by a desired light entrance region along a line.

BRIEF DESCRIPTION OF THE DRAWINGS

A number of exemplary embodiments of the invention are illustrated in the drawings and are explained in greater detail below with indications of further advantages and details.

DETAILED DESCRIPTION OF THE INVENTION

Figure 1:
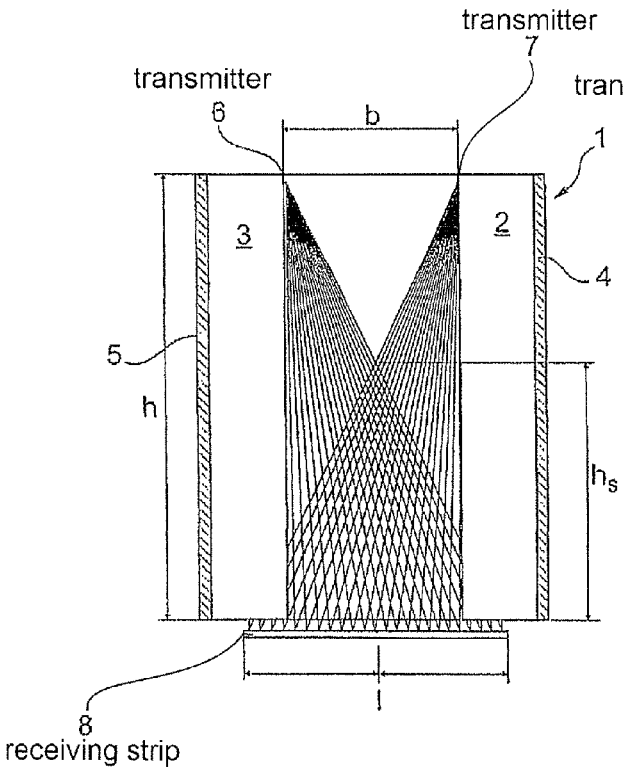
FIG. 1 shows, in a schematic front view, an elevator door with monitoring device according to the invention in an opened state.
Figure 2:
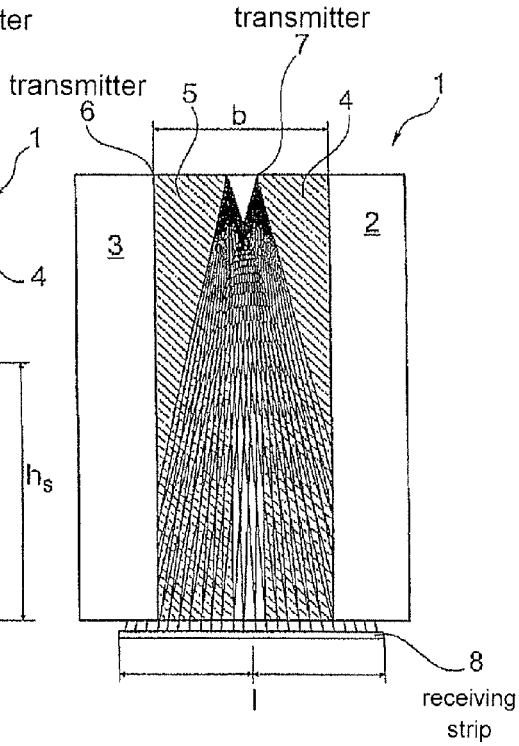
FIG. 2 shows, in an illustration comparable to FIG. 1, the elevator door in an almost closed state.

FIGS. 1 and 2 schematically illustrate a front of a car 1. The car 1 comprises fixed sections 2, 3, which conceal movable door leaves 4, 5.

The fixed sections 2, 3 define a door opening having e.g. a width b of 800 mm and a height h of 2100 mm.

FIG. 1 illustrates the fully opened state of the door leaves 4, 5, in which state the opening has the full width of b. A respective transmitter 6, 7 is arranged at the upper inner corner of the door leaves. The respective transmitters 6, 7 preferably emit in a fan-shaped corridor to a receiving strip 8 mounted on the apron of the car 1.

In the opened state of the door leaves 4, 5, the fan-shaped radiation region of the transmitters 6, 7 intersects for the first time e.g. at a height hs.

The transmitters 6, 7 have a radiation region such that a length l of the receiving strip is preferably fully covered. A multiplicity of receivers, e.g. 24 receivers, are arranged in the receiving strip. Thus, each transmitter 6, 7 with the receivers in the receiving strip 8 can respectively form a light barrier. Given a length l of 1200 mm, for example, with 24 receivers on the receiving strip this results in a pitch of approximately 50 mm.

During the monitoring process, the transmitter 7, for example, firstly irradiates all the receivers of the receiving strip 8. If a receiving element receives no signal, an alarm is triggered. After the transmitter 7, the transmitter 6 is sequentially activated, the latter likewise irradiating all the receivers of the receiving strip 8 simultaneously and in turn triggering an alarm signal in the event of an interruption of a connection between the transmitter 6 and the respective receiver of the receiving strip 8. As a result of the sequential processing of the transmitters 6, 7, it is possible to evaluate a monitoring region in which the evaluation beams from the transmitter 7 and from the transmitter 6 cross one another. The crossing region begins at the height hs and extends as far as the receiving strip 8. As a result of the evaluation of crossed beams, it is possible to achieve a comparatively fine, distinctly finer pitch dimensioning than 50 mm, particularly in a region around the height hs for the detection sensitivity.

In FIGS. 1 and 2, the respective light barriers and beam paths between the transmitters 6, 7 and the receivers of the receiving strip 8 are illustrated schematically by a multiplicity of lines which proceed from the respective transmitter 6, 7 and impinge on the individual receivers of the receiving strip 8. Since the transmitters 6, 7 in the embodiment illustrated are not arranged in stationary fashion on the car, but rather are situated in movable fashion on the door leaves 4, 5, it is possible to achieve densified beam guiding as the door leaves 4, 5 close (see FIG. 2), as a result of which distinctly finer monitoring, and hence the possibility of detecting even small objects, is realized. Moreover, the first intersection region of the monitoring cone is shifted distinctly upward from the height hs, into a region in which it is highly probable that a disturbing object will never occur. By virtue of monitored light paths being pushed together as the door leaves 4, 5 close, it is possible to realize outstanding safety, precisely for the case in which a probability of collision increases as a result of an opening region between the door leaves 4, 5 becoming smaller and smaller.

Figure 3:
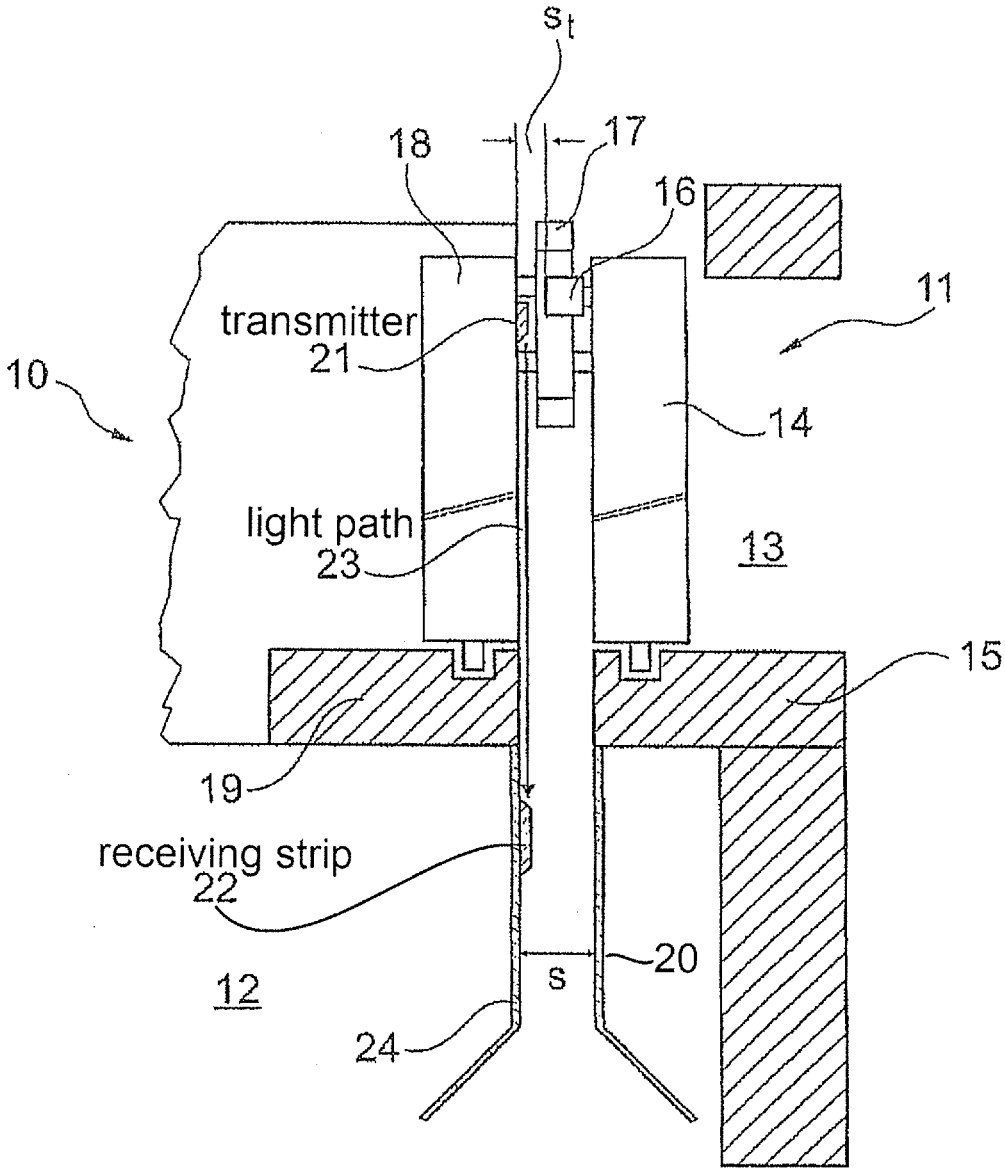
FIG. 3 shows, in a schematic, sectional partial view, a car of an elevator before a stop in an elevator shaft.

FIG. 3 reveals an elevator cabin 10 partly in a schematic sectional view, the elevator cabin being situated in front of a station 11 in a shaft 12.

At the station 11, an opening 13 is provided in the shaft 12, which opening can be closed by at least one shaft door 14.

The shaft door 14 is guided in a displaceable manner in a shaft door threshold 15. The shaft door 14 is actuated via a shaft door roller 16, which can be driven by a driving strut 17 for opening the shaft door 14.

The driving strut 17 is connected to a cabin door 18 of the elevator cabin 10. Thus, a movement of the cabin door 18 driven by a drive in the elevator cabin 10 can be transmitted via the driving strut 17 and the shaft door roller 16 to the shaft door 14 if the elevator cabin is situated in the shaft 12 in front of a station 11.

The cabin door 18, preferably a plurality of cabin doors, is guided e.g. in a cabin door threshold 19 of the elevator cabin 10.

A gap s between the elevator cabin 10 and a shaft wall apron element 20 is reduced to a distinctly smaller value st by a shaft door roller 16 projecting into the gap s with respect to the elevator cabin 10. This reduced gap $s_t$ is relevant for fitting sensor elements on the front of an elevator cabin with respect to the shaft.

If it is assumed that the gap s is approximately 25 mm, only a few millimeters remain for a construction within the gap dimension st for sensor elements which project on the elevator cabin 10 to the shaft 12.

In the exemplary embodiment in accordance with FIG. 3, a transmitter 21 is arranged in the upper region of the cabin door 18, the transmitter radiating onto a receiving strip 22 having a multiplicity of receiving elements. A light path is symbolized by an arrow 23.

The thickness of the transmitter 21 and also of the receiving strip 22, which is mounted e.g. on an apron 24 of the elevator cabin 10, is preferably only a few millimeters, e.g. <5 mm. It can thereby be ensured that both transmitter and receiver do not collide with e.g. a shaft door roller when the elevator cabin 10 moves in the shaft 12.

The receiving strip 22 preferably extends over the complete opening region of the elevator cabin 10 or the shaft opening at the station 11 and has a multiplicity of e.g. identically distributed receivers. The receivers preferably have a spacing of <50 mm. The complete width of the receiving strip 22 can preferably be irradiated by the transmitter 21. Accordingly, monitoring light beams in the manner of a light barrier arise between the transmitter 21 and the receivers in the receiving strip 22.

As soon as one of these light barrier paths is interrupted, for example by a limb of a person who is entering or leaving the elevator cabin, an alarm signal is implemented, which e.g. stops and, if appropriate, reverses the cabin door 18 and hence the shaft door 14.

Figure 4:
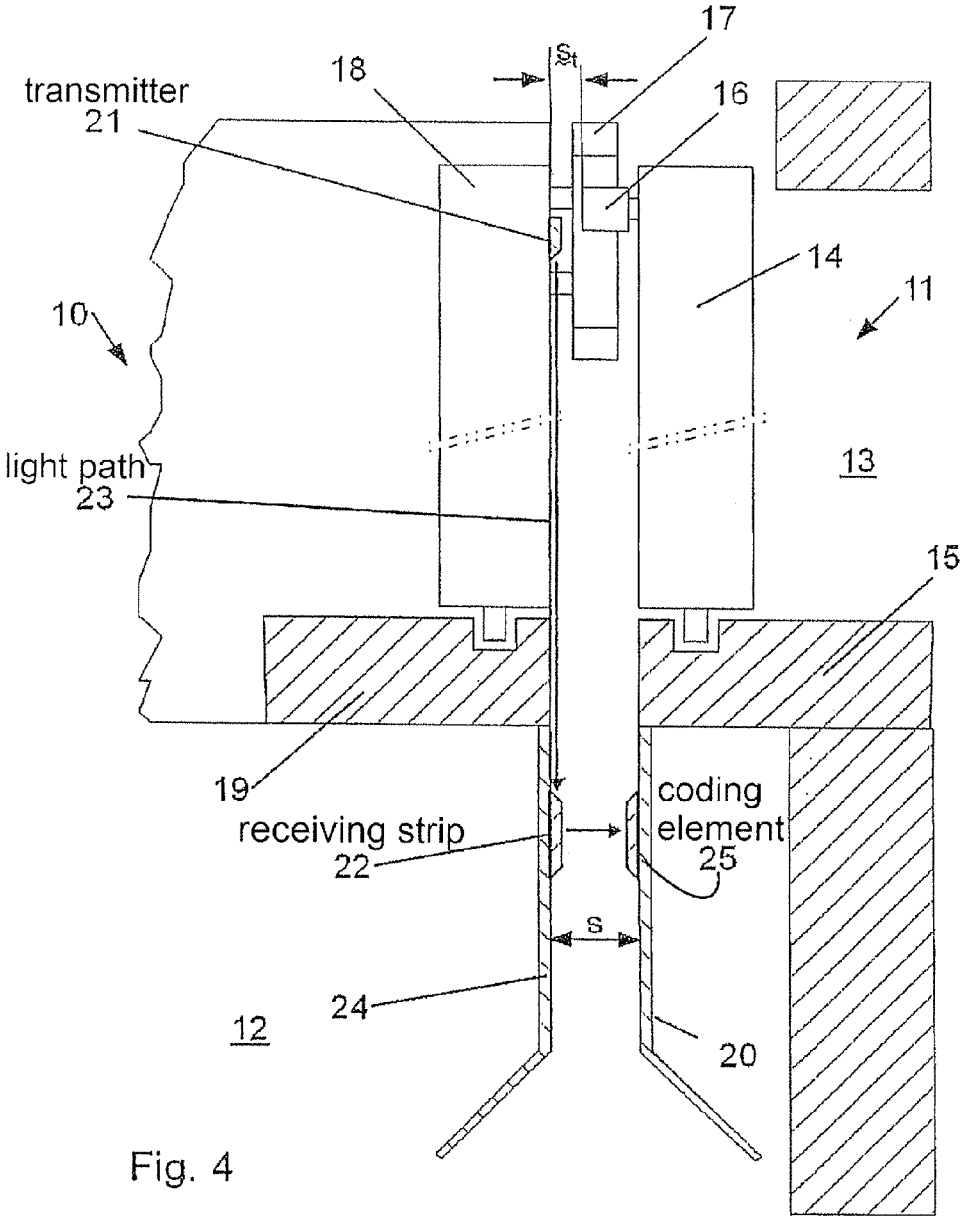
FIGS. 4 and 5 show, in an illustration comparable to FIG. 3, two further exemplary embodiments.

The embodiment in accordance with FIG. 4 corresponds to the embodiment in accordance with FIG. 3 apart from the additional element 25. This is a coding element, which is arranged on a shaft wall apron 20 opposite the receiving strip 22. Preferably, a sensor is present in the receiving strip 22 or separately, which sensor is able to detect the coding of the coding element 25. The coding comprises e.g. information about a storey, such that, by detecting the coding, it is possible to communicate the storey to a controller. The additional sensor preferably not only identifies the coding with regard to a storey, but also uses it for precise positioning of the elevator cabin (10) within a station 11 in the respective storey.

Figure 5:
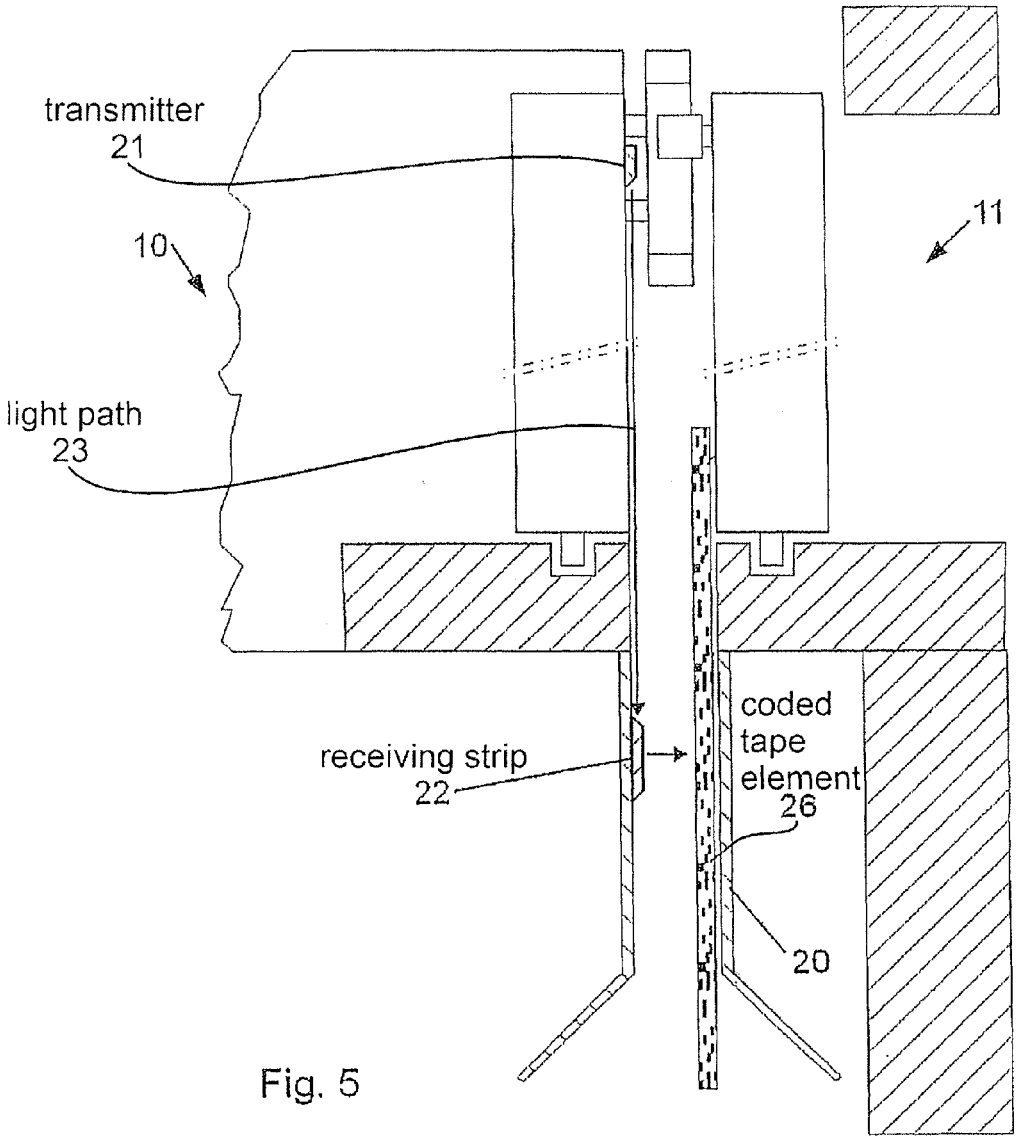

For storey information and/or precise positioning of an elevator cabin 10 at a station 11, a coded tape element 26 can be used as in the further embodiment in accordance with FIG. 5. The information on this coded element can be detected e.g. by an additional sensor, which can be incorporated into the receiving strip 22, and be forwarded to a controller.

A code tape can run continuously in a shaft. If appropriate, however, it is embodied only in a partial fashion; by way of example, the code tape is as long as the apron 20.

A coded tape element can allow an absolute detection of a position, which is possible when the additional sensor is situated above the coded tape element.

In principle, an absolute value measurement is also conceivable with the coding element 25.

LIST OF REFERENCE SYMBOLS

1 Car
2 Fixed section
3 Fixed section
4 Door leaf
5 Door leaf
6 Transmitter
7 Transmitter
8 Receiving strip
10 Elevator cabin
11 Station
12 Shaft
13 Opening
14 Shaft door
15 Shaft door threshold
16 Shaft door roller
17 Driving strut
18 Cabin door
19 Cabin door threshold
20 Shaft wall apron element
21 Transmitter
22 Receiving strip
23 Arrow light path
24 Apron
25 Coding element
26 Coding tape
27 Building wall above opening
28 Building wall below shaft door threshold

We claim:

1. A monitoring device for safeguarding a driven element against undesired collisions with an object lying on the movement path of the driven element, said monitoring device comprising at least one transmitting element and a multiplicity of receiving elements, wherein the at least one transmitting element is arranged in a horizontal upper boundary region of an opening to be monitored, which opening can be at least partially closed by the driven element, and the multiplicity of receiving elements are arranged in a horizontal, opposite lower boundary region in distributed fashion along the opening to be monitored, wherein the at least one transmitting element forms a light barrier arrangement with each of the multiplicity of receiving elements to form a fan-shaped passageway, which can be evaluated in each case by evaluation means, wherein the multiplicity of receiving elements, for distributed arrangement along the opening to be monitored, are distributed over an at least approximately complete horizontally extending opening region.

2. A device according to claim 1, wherein the at least one transmitting element is arranged in each case in a region of a left and right upper lateral boundary of the opening.

3. A device according to claim 1, wherein the at least one transmitting element is positioned approximately centrally in the upper horizontal boundary region of the opening.

4. A device according to claim 1, wherein the evaluation means performs one of a sequential evaluation and a parallel evaluation of the receiving elements.

5. A device according to claim 1, wherein the device comprises more than three transmitting elements in the horizontal upper boundary region of the opening.

6. A device according to claim 1, wherein the receiving elements are mounted on an apron of a car of an elevator.

7. A device according to claim 1, wherein the receiving elements are mounted on a car of an elevator by means of clips and/or screws.

8. A device according to claim 1, wherein the receiving elements are mounted in the door threshold of a car of an elevator.

9. A device according to claim 1, wherein at least one of the receiving elements and transmitting elements are arranged in a strip.

10. A device according to claim 1, wherein the at least one transmitting element is mounted on a car in one of a fixed manner and in a manner concomitantly moving on the driven element.

11. A device according to claim 1, wherein at least one of the transmitting element and receiving elements, in an incorporated state, have a significantly larger optical aperture angle along an opening width (b) of an opening to be monitored than in a direction transverse with respect thereto.

12. A device according to claim 1, wherein the receiving elements have a mounting thickness of <5 mm.

13. A device according to claim 1, wherein the at least one transmitting element is arranged in a horizontal upper boundary region and the receiving elements are arranged in a horizontal lower boundary region of the opening to be monitored.

14. A monitoring device for safeguarding a driven element against undesired collisions with an object lying on the movement path of the driven element, said monitoring device comprising at least one transmitting element and a multiplicity of receiving elements, wherein the at least one transmitting element is arranged in a horizontal lower boundary region and the receiving elements are arranged in a horizontal upper boundary region of the opening to be monitored, which opening can be at least partially closed by the driven element, and the multiplicity of receiving elements are arranged in a horizontal, opposite lower boundary region in distributed fashion along the opening to be monitored, wherein the at least one transmitting element forms a light barrier arrangement with each of the multiplicity of receiving elements to form a fan-shaped passageway, which can be evaluated in each case by evaluation means, wherein the multiplicity of receiving elements, for distributed arrangement along the opening to be monitored, are distributed over an at least approximately complete horizontally extending opening region.

15. A device according to claim 1, wherein an upper side of the receiving elements is oblique or rounded.

16. A device according to claim 1, wherein a strip with receiving elements is designed in flexibly pliable fashion.

17. A device according to claim 1, wherein only those receiving elements which are situated in an open region of the opening to be monitored are active and evaluated by the evaluation means.

18. A device according to claim 1, wherein at least one of the receiving elements and the at least one transmitting element further comprises an optical waveguide means.

19. A device according to claim 1, wherein coding means, and a sensor for detecting the coding means are provided in order to be able to carry out position detection for an elevator.

20. An elevator comprising a device according to claim 1.

* * * * *